US007690135B2

(12) United States Patent
Yu et al.

(10) Patent No.: US 7,690,135 B2
(45) Date of Patent: Apr. 6, 2010

(54) DEEP SEA MINING RISER AND LIFT SYSTEM

(75) Inventors: Chenteh Alan Yu, Houston, TX (US); Robert Schoenberg, Houston, TX (US)

(73) Assignee: Technip France, Courbevoie (FR)

( * ) Notice: Subject to any disclaimer, the term of this patent is extended or adjusted under 35 U.S.C. 154(b) by 3 days.

(21) Appl. No.: 12/236,023

(22) Filed: Sep. 23, 2008

(65) Prior Publication Data

US 2009/0077835 A1 Mar. 26, 2009

Related U.S. Application Data

(60) Provisional application No. 60/974,472, filed on Sep. 23, 2007.

(51) Int. Cl.
*E02F 1/00* (2006.01)
*E02F 9/02* (2006.01)

(52) U.S. Cl. ..... 37/314; 37/309

(58) Field of Classification Search ..... 405/195.1, 405/224.4, 223.1; 166/350, 359, 367, 243; 114/293, 264; 37/309–345
See application file for complete search history.

(56) References Cited

U.S. PATENT DOCUMENTS

| | | | | |
|---|---|---|---|---|
| 3,438,142 A | | 4/1969 | Krutein | |
| 3,868,312 A | * | 2/1975 | Wanzenberg et al. | 205/560 |
| 4,030,216 A | | 6/1977 | Willums | |
| 4,195,426 A | | 4/1980 | Banzoli et al. | |
| 4,232,903 A | | 11/1980 | Welling et al. | |
| 4,317,174 A | * | 2/1982 | Dean | 701/116 |
| 4,601,252 A | * | 7/1986 | Wuttudal | 114/230.12 |
| 6,045,296 A | * | 4/2000 | Otten et al. | 405/195.1 |
| 6,708,765 B1 | * | 3/2004 | Eilertsen | 166/350 |
| 6,899,049 B2 | * | 5/2005 | Gehring | 114/264 |

FOREIGN PATENT DOCUMENTS

WO 9907949 2/1999

OTHER PUBLICATIONS

Saida Isliy, Invitation to Pay Additional Fees—Communication Relating to the Results of the Partial International Search for International Patent Application No. PCT/US2008/083513, dated May 19, 2009, European Patent Office, Germany.
Coralie Bultot, International Search Report for International Patent Application No. PCT/US2008/083513, dated August 3, 2009, European Patent Office, Germany.
Coralie Bultot, Written Opinion for International Patent Application No. PCT/US2008/083513, dated August 3, 2009, European Patent Office, Germany.

* cited by examiner

*Primary Examiner*—Robert E Pezzuto
(74) *Attorney, Agent, or Firm*—Locke Lord Bissell & Liddell LLP

(57) ABSTRACT

Applicants have created a method and system of deep sea mining comprising mining SMS deposits from the sea floor with a subsea miner, pumping the solids from the subsea miner through a jumper and pumping the solids from the jumper up a riser to a surface vessel. Further, applicants have created a method of deploying a deep sea mining system, comprising stacking a riser hangoff structure on top of a subsea pump module forming an assembly; picking up the assembly by a hanging mechanism, hanging the assembly on a moon pool, attaching a first riser joint; disconnecting the riser hangoff structure from the assembly; and attaching at least one second riser joint to form the riser.

24 Claims, 9 Drawing Sheets

DEEP SEA MINING RISER AND LIFT SYSTEM

CROSS REFERENCE TO RELATED APPLICATIONS

This application claims the benefit of U.S. Provisional Application Ser. No. 60/974,472 filed Sep. 23, 2007, which is incorporated by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to deep sea mining; and more specifically related to a deep sea mining riser and lift system for mining and producing solids including seafloor massive sulfide (SMS) deposits.

2. Description of the Related Art

Seafloor massive sulfide deposits, or SMS deposits, are modern equivalents of ancient volcanogenic massive sulfide ore deposits or VMS deposits. SMS deposits are currently forming in the deep ocean around submarine volcanic arcs, where hydrothermal vents exhale sulfide-rich mineralizing fluids into the ocean. SMS deposits are laterally extensive and are comprised of a central vent mound around the area where the hydrothermal circulation exits, with a wide apron of unconsolidated sulfide silt or ooze which precipitates upon the seafloor. Recent finding show that SMS fields have a typical size of about 500 meters wide by 1000 meters long by about 10 to 20 meters deep in a very rugged seafloor terrain. The water depth also ranges from 1,500 meters to 2,500 meters.

Economic extraction of SMS deposits is largely in the theoretical stage, the biggest complication being the extreme water depths at which these deposits are forming. Thus, there remains a need for a deep sea mining riser and lift system for mining and producing solids, such as seafloor massive sulfide (SMS) deposits.

The inventions disclosed and taught herein are directed to improved systems and methods for a deep sea mining riser and lift system for mining and producing solids including seafloor massive sulfide (SMS) deposits.

BRIEF SUMMARY OF THE INVENTION

Applicants have created a method and system of deep sea mining comprising mining SMS deposits from the sea floor with a subsea miner, pumping the solids from the subsea miner through a jumper and pumping the solids from the jumper up a riser to a surface vessel. Further, applicants have created a method of deploying a deep sea mining system, comprising stacking a riser hangoff structure on top of a subsea pump module forming an assembly; picking up the assembly by a hanging mechanism, hanging the assembly on a moon pool, attaching a first riser joint; disconnecting the riser hangoff structure from the assembly; and attaching at least one second riser joint to form the riser.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created method and system of deep sea mining comprising mining SMS deposits from the sea floor with a subsea miner, pumping the solids from the subsea miner through a jumper and pumping the solids from the jumper up a riser to a surface vessel. Further, applicants have created a method of deploying a deep sea mining system, comprising stacking a riser hangoff structure on top of a subsea pump module forming an assembly; picking up the assembly by a hanging mechanism, hanging the assembly on a moon pool, attaching a first riser joint; disconnecting the riser hangoff structure from the assembly; and attaching at least one second riser joint to form the riser.

Figure 1:
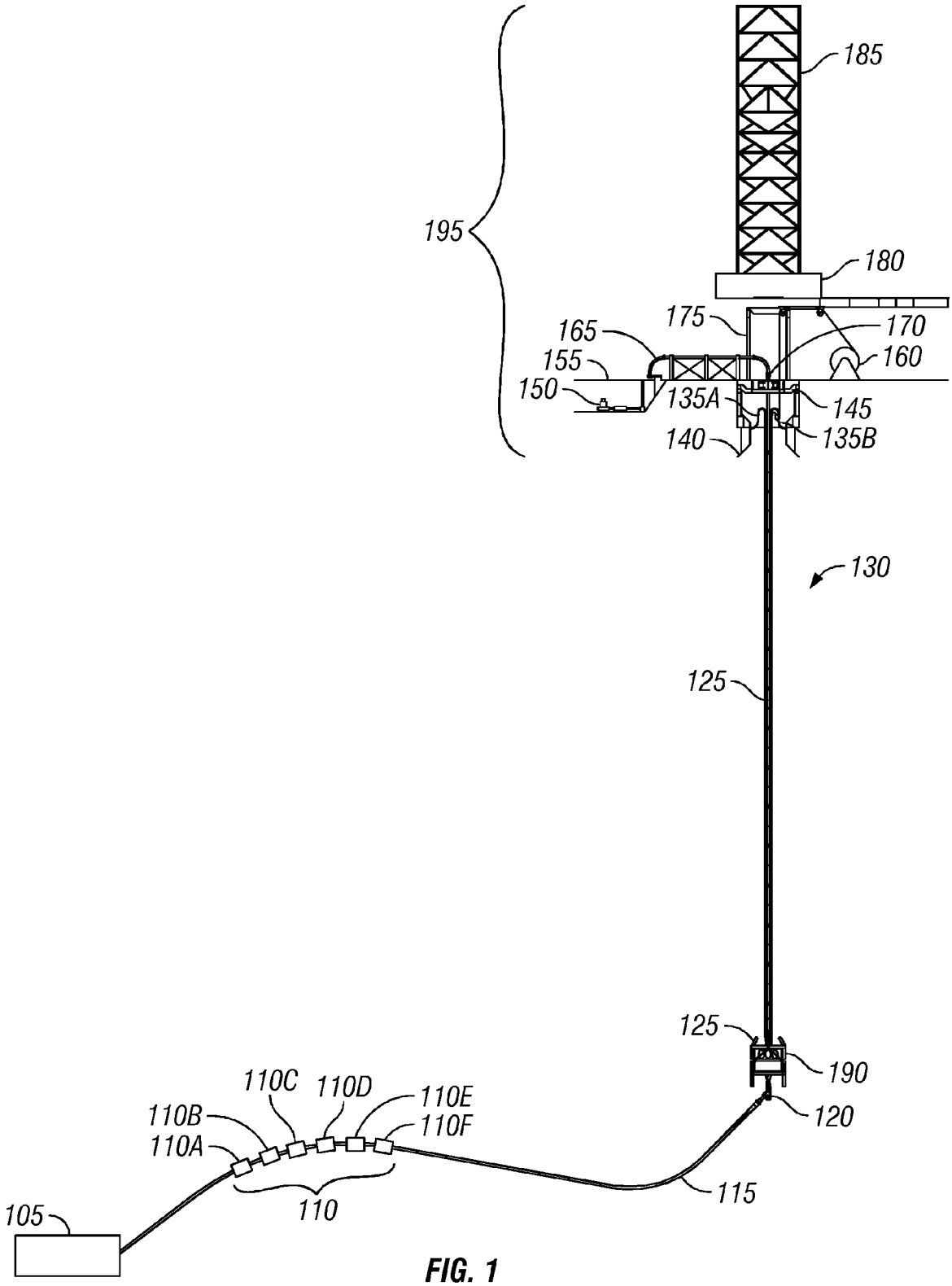
FIG. 1 illustrates a particular embodiment of a deep sea mining riser and lift system utilizing certain aspects of the present inventions.

FIG. 1 is an illustration of a system for mining and producing solids, including SMS, through dynamically suspended subsea pump(s) at the bottom of a vertical riser that extends to the surface vessel using an environmentally safe surface closed loop wastewater system to power the subsea pump. The subsea miner 105 may be used to mine the solids, including SMS, from the seafloor. Recent finding show that SMS fields have a typical size of about 500 meters wide by 1000 meters long by about 10 to 20 meters deep in a very rugged seafloor terrain. The water depth also ranges from 1,500 meters to 2,500 meters. The subsea miner 105 may work on the rugged terrain with slopes as high as 25 degrees. Therefore, the subsea miner 105 ideally would be designed to perform under these rugged deep sea conditions. The subsea miner 105 could be designed to mine the SMS by performing any combination of the following steps, including, but not limited to (1) excavating the SMS from the fields located on the seabed floor, (2) breaking down the SMS into chunk sizes using a cutter mounted on the excavator, and (3) forcing the SMS into in a crusher to crush the SMS into manageable sizes to ensure the SMS passes through the jumper 115. Many variations and embodiments are envisioned for the subsea miner 105.

The jumper 115 may also be referred to as the horizontal transport pipe or a riser transport pipe. The jumper may be configured in an "S" shape and be positioned in a horizontal direction to decouple the pump motion and vessel motion from the subsea miner 105. When the jumper is configured in an "S" shape it allows for some slack between the subsea miner 105 and the dump valve assembly 120 so that when the two devices move the subsea miner 105 is not upset, overturned or otherwise disrupted due to a tension in the jumper 115. The force exerted by the subsea pump 190 on the subsea miner 105 may also be minimized. Without decoupling the motion, the pulling force exerted on the subsea miner 105 compounded with high field angle may topple the subsea miner 105.

The other function of the "S" shape jumper 115 is to provide a gentle slope and large radius to lower the centrifugal force of solids passing through the jumper 115. A large radius may lower the centrifugal force and wear. The large radius of the jumper may provide the product mixture flow to be away from the particle impact wears mechanism and into the sliding wear mechanism. The two key parameters of the sliding wear are the flow velocity V and the radius R. The jumper 115 may be rotated along its axis for making up to the dump valve assembly 120 and the subsea miner 105. By doing so, the curved up side on the buoyed section 110 is rotated out from field to field, which may increase the field service life of the jumper. To keep track of the rotating, special markings can be used to keep track of the curved side of the jumper 115 to increase the service life. For example, for a 200-meter long jumper, the nominal horizontal distance between the dump valve and the subsea excavator is at 125 meters +/−25 meters. The elevation differences between the dump valve and the excavator can be as high as +/−25 meters. For a field with 180 meters total elevation changes, the length of the riser 130 may only need to be changed limited number of times.

The subsea miner 105 may maintain its horizontal duration and "S" shape using a number of apparatuses and techniques. First, bouncy devices, such as buoys (collectively 110) may be used to float the jumper 115 at the ideal location. Second, the proper distance between the subsea miner 105 and the dump valve assembly 120 may be maintained by using a system to control the position of the surface vessel 195, such as a dynamic position ship, ship shaped vessel or deep sea barge. In order to maximize the production up time and to maintain the horizontal "S" shape of the jumper 115, a dynamic position vessel tracking may be used to track the subsea miner 105. To do so, transponders may be mounted on the subsea miner 105 as well as the dump valve assembly 120. The position and elevation of the subsea miner 105 and the dump valve may be fed to a computer on board a surface vessel 195, such as dynamic positioning vessel for computing the horizontal and vertical distance between the subsea miner 105 and the dump valve assembly 120. An operational window of the horizontal and vertical distances may also be provided. Once those distances are outside of the provided operational window, either the nominal location of the surface vessel 195 (and as a result the dump valve assembly 120) or the length of the riser 130 may need to be adjusted. For example, for a 200-meter long jumper 115, the horizontal distance between the dump valve assembly 120 and the subsea miner 105 would ideally be maintained at 125 meters +/−25 meters and the elevation to be maintained at 30 meters +/−25 meters. It should be noted that due to the connection, the dump valve assembly 120 may move with surface vessel 190 The horizontal distance between the surface vessel 195 (and as a result the dump valve assembly 120) and the subsea miner 105 may be maintained by moving the surface vessel 195. However, if the elevation difference is outside of the +/−25 meters operational, joints from pup joint set may need to be added to or removed from the riser 130 to lengthen the riser 130 to compensate the elevation differences.

In its exemplary embodiment, the internal diameter of the jumper 115 may be purposely sized smaller than the vertical pipe to increase the flow speed to prevent solids from settling inside the horizontal transport pipe. The term "coupled," "coupling," and like terms used herein relative to the inventions described includes any method or devices for securing, bonding, fastening, attaching, engaging, joining, inserting therein, or forming on, in or with other associated members as an integral component or not. After the solids have been mined by the subsea miner 105, which is coupled to the jumper 115, the solid may be transported through a jumper 115.

The solids may then be transported through the dump valve assembly 120, up through the riser main tube 125 to the surface vessel 195. The subsea pump(s) 190 may be configured into two sub-modules with one sub-module sufficient for partial production. One of water injection line 135 is routed to power one pump sub-module for redundancy. The subsea pump(s) 190 inside the dump valve assembly 120 may be passively hanging at the bottom of the riser 115.

Proper tensions may be important to any vertical riser systems, including riser 125, especially in this water depth in order to maintain the shape of the risers, to prevent clashing with adjacent equipment, and to reduce cyclic stress intensities along the riser 130. By placing the subsea pump(s) 190 at the bottom of the riser 130, the entire riser 130 may receive the needed riser tension due to the weight of the subsea pump(s) 190. In the preferred embodiment, the ideal tension factor may be greater than 1.2. The tension factor is defined as the ratio of the top end tension to the submerged weight of the riser string. For example, if the pump modules weigh from 100 to 150 tons placed at the bottom and the outer diameter of the rider is thirteen to fourteen inches with a one-half to three-quarter inch wall, a 1.2 tension factor can be achieved.

The systems describe herein may be ideally designed to have the pumping power and efficiency to lift the solids, especially SMS, from the deep seafloor to the surface. Further, the vertical riser, or simply riser 130 may be designed with the proper tension as discussed above, for coping with the flow induced vibration, current and vessel motion induced fatigue. Upon arriving at the top end of the riser 130, the solids, such as SMS, may be dewatered. The wastewater from the dewatering may be pumped out at the surface or preferably pumped into the water injection lines 135A and 135B (collectively 135) which may be piggy backed onto the riser main tube 125 (both contained in riser 130) down to the compression chamber of the pumps modules 190. The wastewater can be used to power the compression chamber of the pump(s) 190 to lift the solids to the surface vessel 195. The wastewater can then be discharged into a diffuser to reduce the wastewater speed and pressure prior to discharging into the sea floor. To avoid the wastewater disposal-created side load and pluming, a subsea diffuser will be devised at the end of the discharge line to discharge wastewater horizontally with the discharge force balanced in horizontal direction. This arrangement of the wastewater and water injection lines 135 forms a surface closed loop for wastewater disposal. In this embodiment, the wastewater is utilized to power the subsea pump(s) 190 and then discharged into the sea at the sea floor level. As a result, either all the solids mined from the seafloor are captured in the surface vessel as solid product or as the wastewater residual which is discharged back into the sea floor. The process of cycling the wastewater may occur in about fifteen minutes. This type of arrangement may form a surface closed loop wastewater system. The discharging the wastewater close to the seafloor as opposed close to the sea level is environmental friendly and allows the wastewater to power the subsea pumps 190. Further, this embodiment discharges the wastewater close to the seafloor without additional risers because the wastewater travels down the single riser 130 of this embodiment.

There may be situations were the dump valve assembly 120 may need to be disconnected from the riser 130 and thus the surface vessel 195. For example, in the event of the dynamic system failure, the top end of the dump valve assembly 120 is equipped with (1) a subsea remotely operated vehicle (ROV) operated or (2) a pump power pack operated hydraulic connector which can be disconnected to protect the jumper 130 from being overstretched or subsea miner 105 being toppled. The ROV may be kept on standby to execute the disconnect procedure. To disconnect the dump valve assembly 120, the ROV may grab the jumper handle bar of the control panel on the subsea pumps 190. The valve sequencing on the vessel may be prepared for an emergency disconnect. The ROV may then disconnect the hydraulic connector between the dump valve assembly 120 and the riser 130. If an ROV is not available or desirable, another option may be to connect the hydraulic circuits of the hydraulic connector to the control panel of the subsea pumps 190. An umbilical for sending the hydraulic or electric signals from the pump control panel may be installed in the control room of the surface vessel 195. Once disconnected the dump valve assembly 120 along with the horizontal jumper 115 may drop to the sea floor. A recovery procedure may be carried out to retrieve the dump valve assembly 120 and the horizontal jumper 115.

There are at least two types of wear mechanism in slurry transport: (1) the sliding wear and (2) the particle impact wear. The vertical section of the main riser is susceptible mainly to the sliding wear with the exception of the pump exit at the bottom and the top end elbow exit for the vertical riser configuration shown in FIG. 10. These non-straight areas will have turbulence flow and eddy current around the discontinuities, which may cause wear and an attrition effect. For the vertical riser section, the high strength and yet ductile material may be selected along with a one-eighth inch wear allowance for the wall thickness to cope with the potential wear. The combination of the unknown particle size distribution, hardness, PH values and volumetric concentration in the fluid all pointed to the post facto test program for quantifying the wear coefficient for the future projects. An outer diameter ultrasonic in-situ periodic examination of the wall thickness in the strategic areas of the vertical riser may provide a way to ensure that a sufficient wall thickness remains for the remaining production period. For the pump exit where the turbulence flow may be prevalent, a one half inch wear allowance may be implemented along with the forgings having high chrome contents. The riser system outer diameter may also be coated with thermally sprayed aluminum with anodes placed in the pump modules and near the moon pool. Electric continuity along the entire riser may be added to affect the corrosion protection system. The interaction of the wear and corrosion may be minimized with the systems and methods described above.

Figure 2:
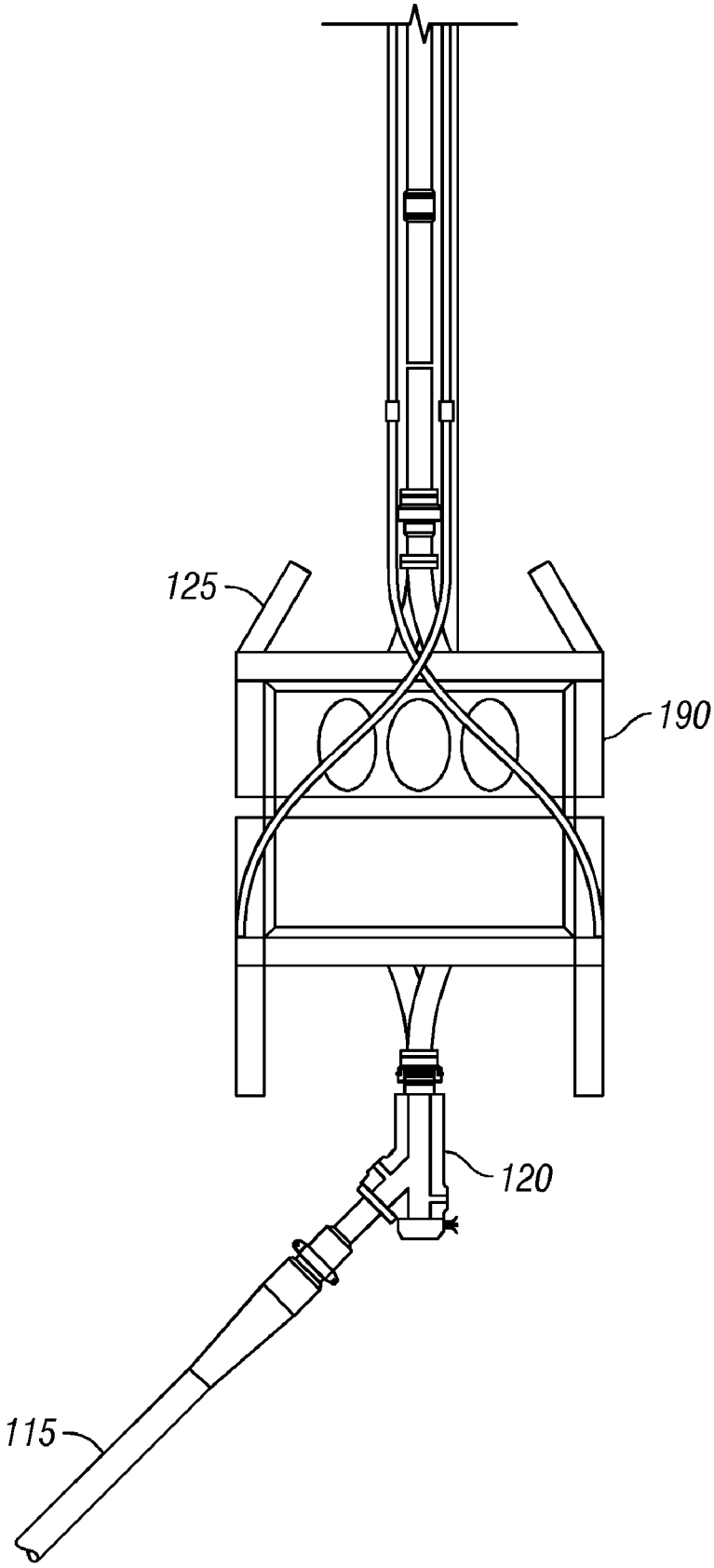
FIG. 2 illustrates a particular embodiment of a bottom dump valve connection utilizing certain aspects of the present inventions.

FIG. 2 is an illustration of the bottom of the pump being suspended above the sea floor, preferably about thirty meters. This distance is ideal to ensure that the bottom of the subsea pump(s) 190 do not contact the sea floor during the production operation. A dump valve assembly 120 at the vicinity of pumps may be desirable when solids in the riser 130 fall and accumulate at the bottom of the riser 130, such as when the water power is interrupted or the pumping action stops. To remove the fallen solids, the dump valve assembly 120 may be opened to allow the cumulated solids to be dumped out and the production restarted. The dump valve assembly 120 may be opened and closed either opening a manually operated valve with the ROV or a power pack assisted operation from the subsea pump(s) 190. A full bore passage and shute may be needed to dump quickly the solids out and to direct the solids away from the subsea pump(s) 190 top. The ROV may be used to ensure the solids are not obstructing the riser 130 and to close the dump valve assembly 120 for resuming production.

Figure 3:
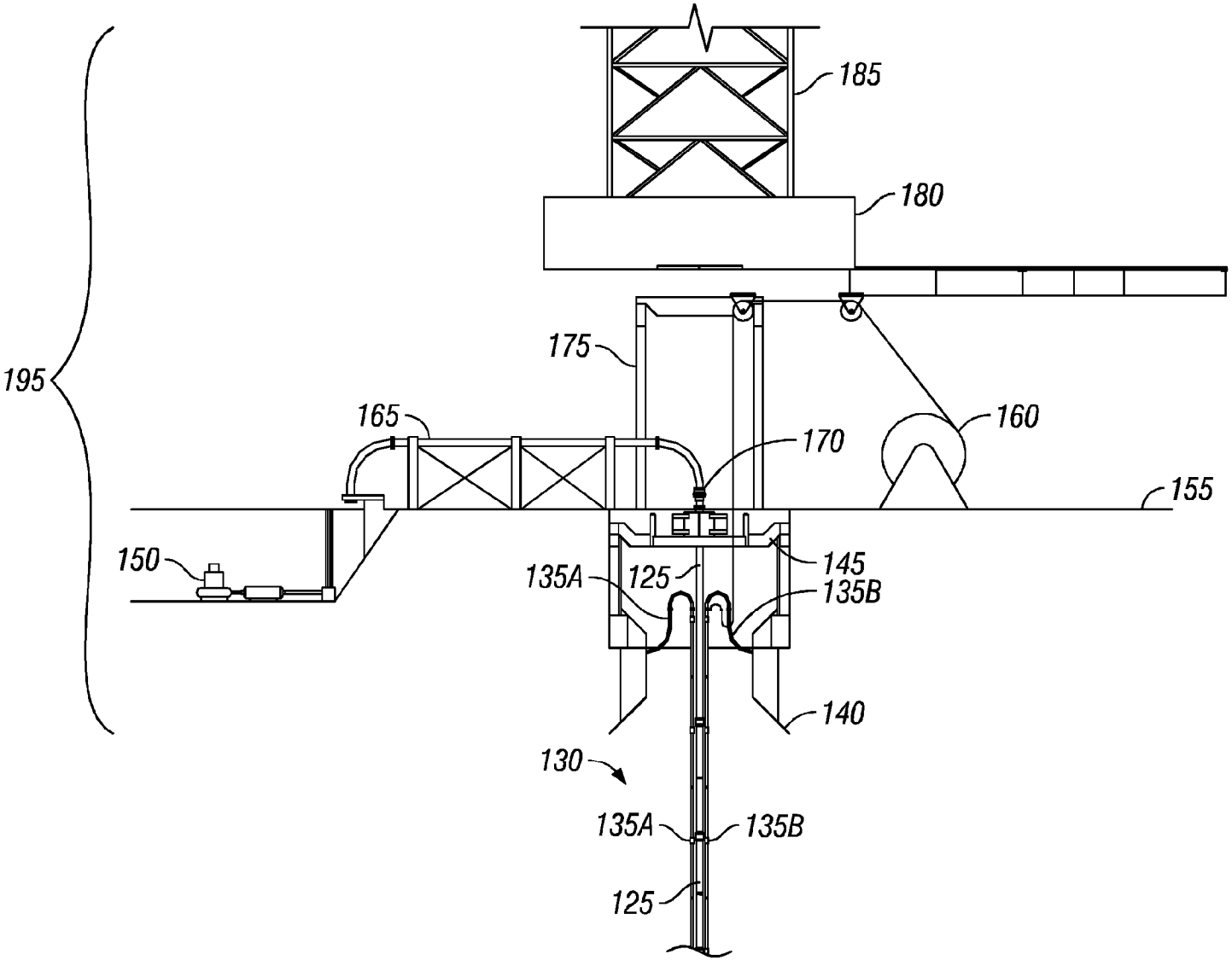
FIG. 3 illustrates a particular embodiment of a top end termination of a deep sea mining riser and lift system utilizing certain aspects of the present inventions.

FIG. 3 is an illustration of the dual surface closed loop water injection lines 135 for environmental safe wastewater disposal and lift system redundancy. The figure depicts the top end termination of the riser system where a upper termination spool or flex joint 170 is supported in a support receptacle which in turn is supported by a spider beam structure 145. Also shown in FIG. 3 are the dual water injection lines 135A and 135B (collectively 135) from the dewatering system to top of the riser 130. The produced solids and water mixture may be dumped into the dewatering hopper through the surface production spool 165. The wastewater may be filtered and pumped into the water injection lines 135 by the filter 150. The water injection lines 135 may be bundled to the main riser pipe 125.

Figure 4:
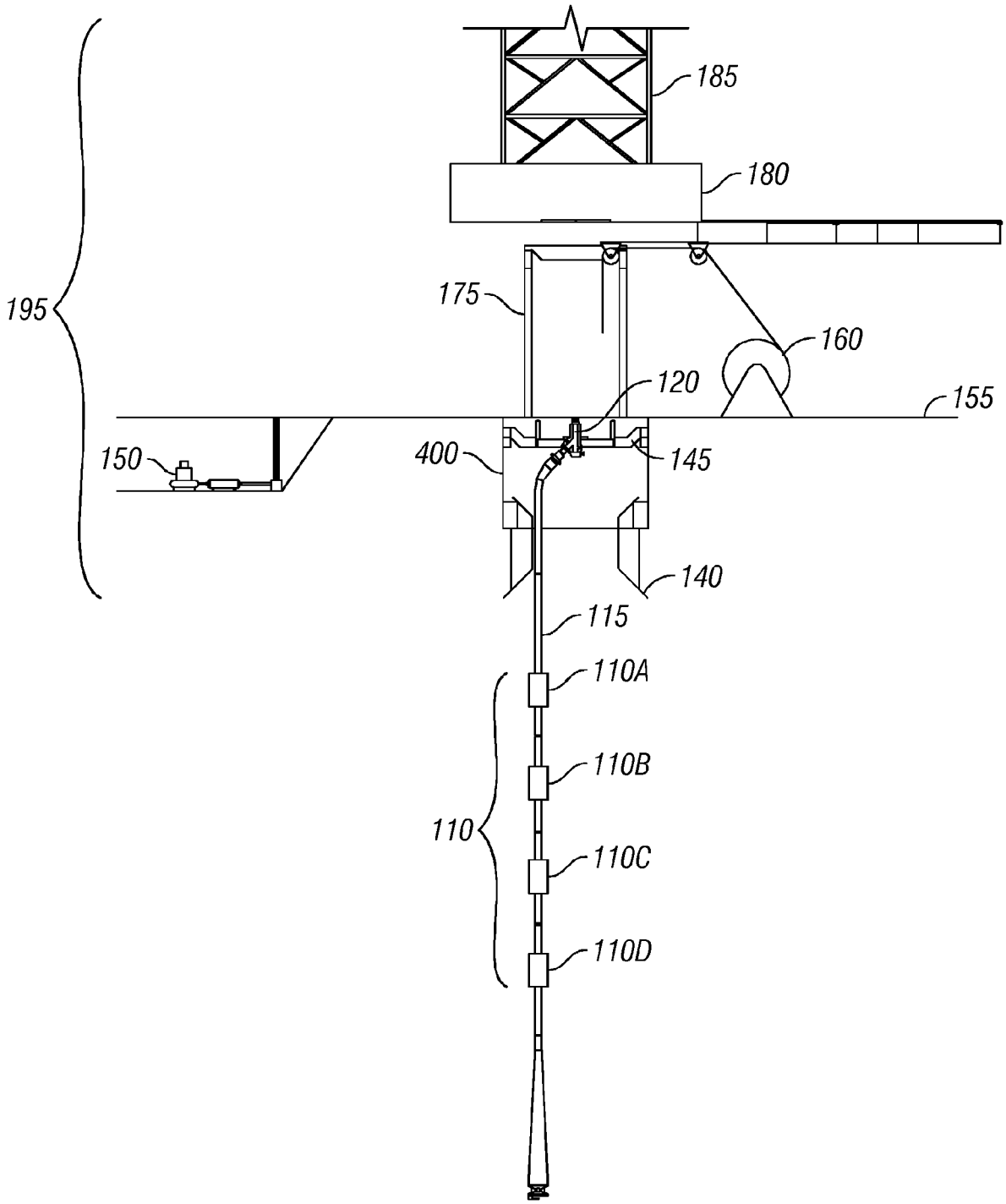
FIG. 4 illustrates a particular embodiment of an installation of a jumper on the dump valve utilizing certain aspects of the present inventions.
Figure 5:
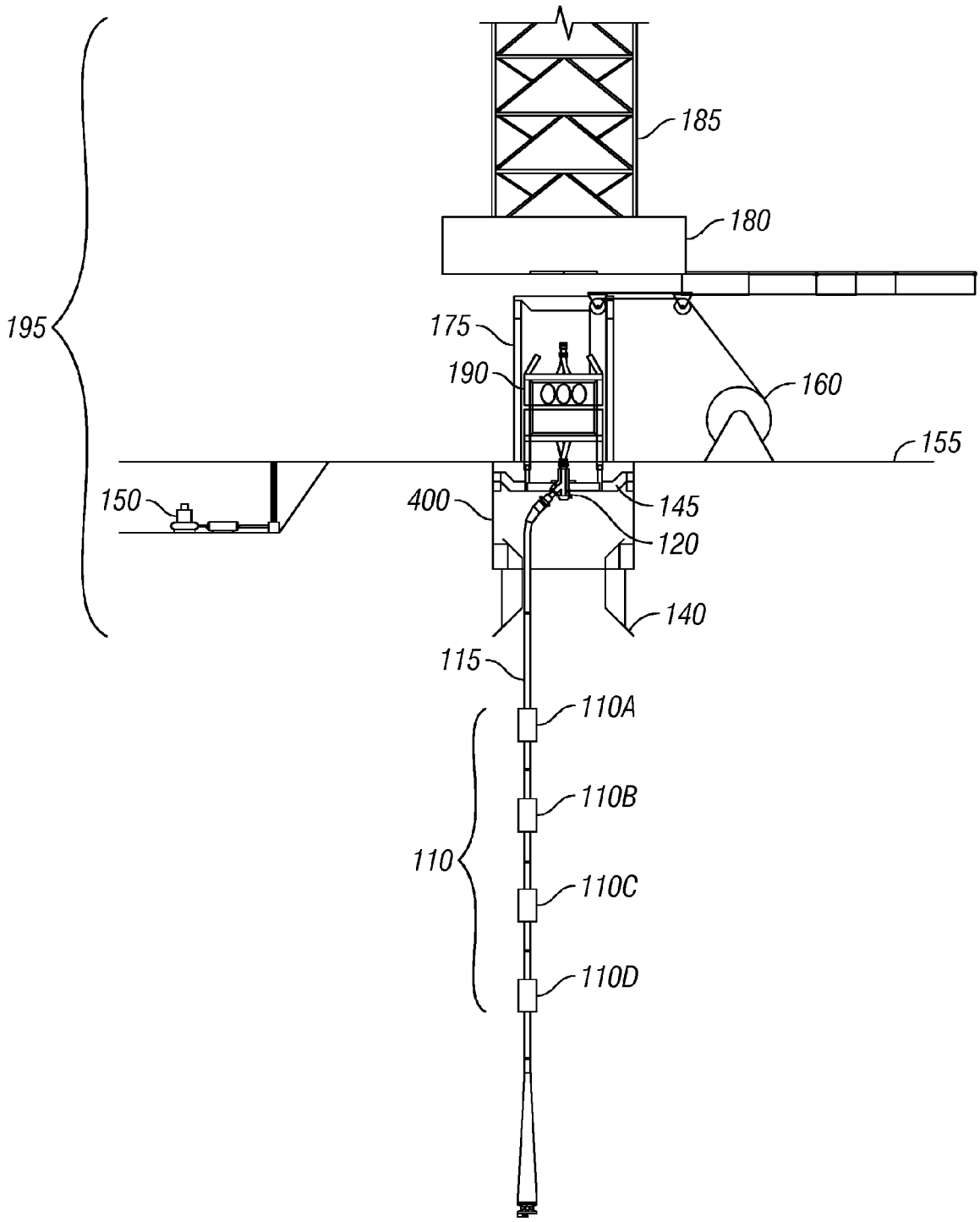
FIG. 5 illustrates a particular embodiment of an installation of subsea pumps on a dump valve utilizing certain aspects of the present inventions.
Figure 6:
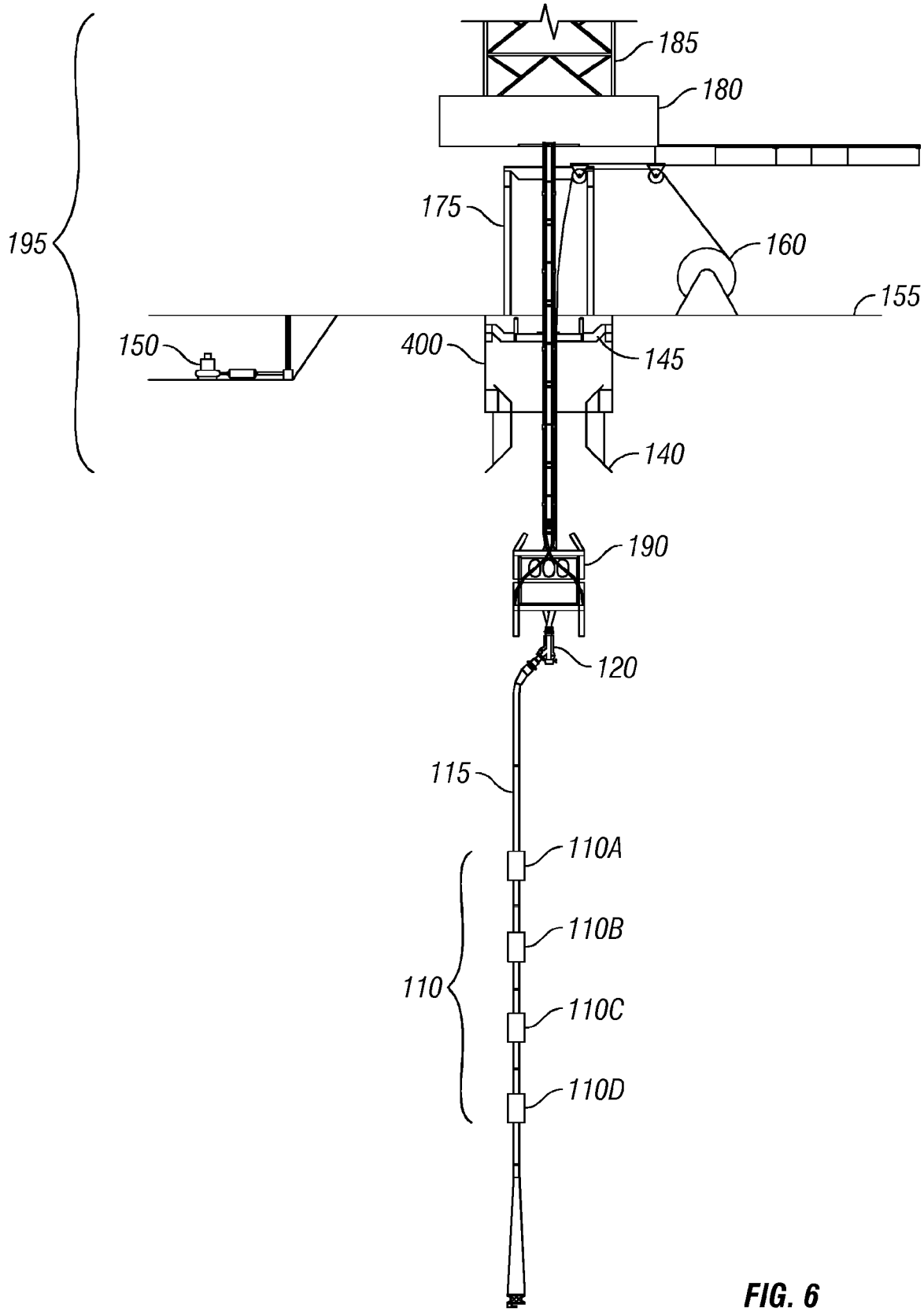
FIG. 6 illustrates a particular embodiment of an installation of a latch riser joint onto the pump module utilizing certain aspects of the present inventions.

FIGS. 4 to 6 are illustrations of an exemplary embodiment of a rig and hoisting system for deploying and retrieving the riser and lift system. FIGS. 4 to 6 illustrate the sequence of installing an exemplary riser and lift system. The dump valve assembly can be the first assembly to be presented in the moon pool 400 and onto the spider beam 145. The moon pool may be designed to be a large enough opening to allow the passage of the subsea pump(s) 190. The jumper 115 may be stored on the spool. A messenger line can be installed and connected from the moon pool to the horizontal jumper pulling head. With the assistance of a ROV, the jumper 115 can be presented to the moon pool vertically as shown in FIG. 4. The upper end of the jumper 115 is connected to the side inlet of the dump valve assembly 120. Due to the eccentric load, the spider 145 can be designed to support and keep the dump valve assembly 120 and the jumper 115 assembly upright for connecting to the subsea pump(s) 120. For safety reasons, a hydraulic connector assembly can be assembled below the bottom of the subsea pumps 190 with the hydraulic plumbing routed to the pump control interface. As is shown in FIG. 5, the two water injection line receptacles can be assembled next to the male hydraulic connector. The hydraulic connector may be landed onto the male hydraulic connector with the water injections line stab in the receptacle at the same time. The o-ring type of seals may be used to seal the water injection lines against their receptacles. A dummy ROV hot stab may be needed to actuate the hydraulic lock function after the hydraulic connector is properly landed on top of the dump valve. An indicator rod on the hydraulic connector can show the proper make up of the hydraulic connector. The subsea pump 190 may then picked up by the rig 180. As is shown in FIG. 6, the spider beam 145 may open to allow the pump to pass through then closed to support the subsea pump(s) 190 at the transition joint. The first riser joint can be presented to the moon pool 140 then connected to the top of the pump. The same procedure is used to run the entire riser string.

Figure 7:
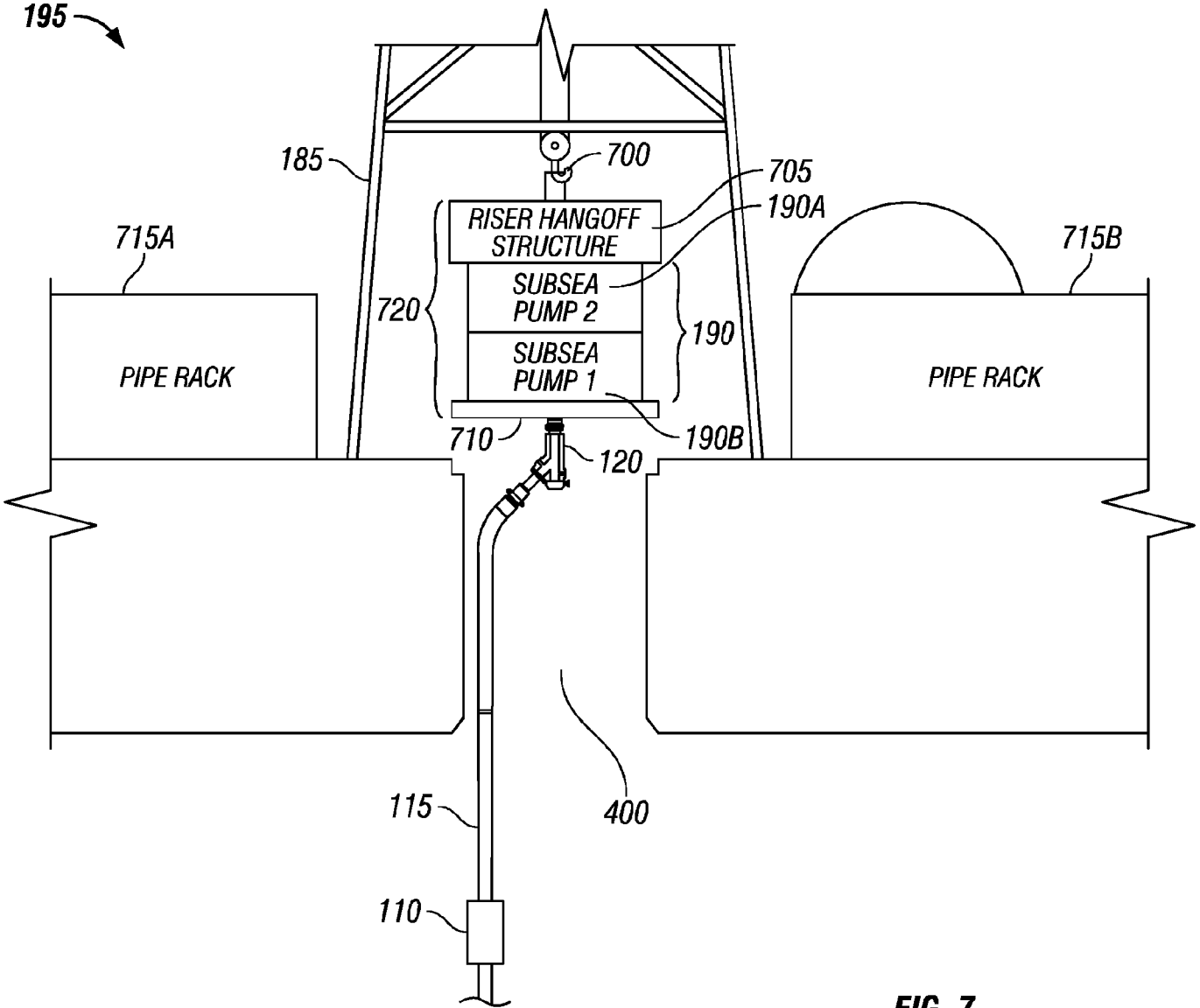
FIG. 7 illustrates a particular embodiment of the deployment of the deep sea mining riser and lift system utilizing certain aspects of the present inventions.
Figure 8:
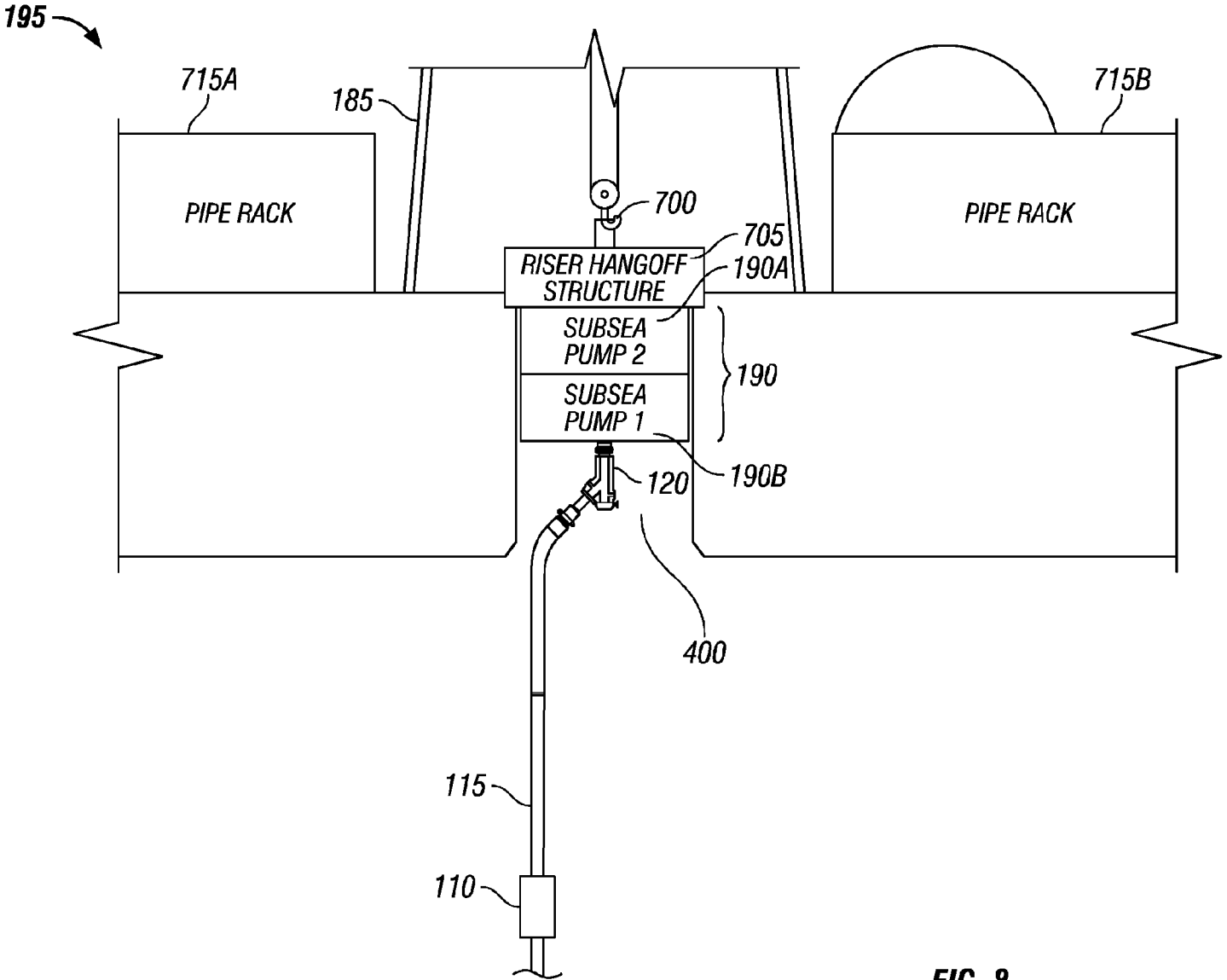
FIG. 8 illustrates a particular embodiment of the deployment of the deep sea mining riser and lift system utilizing certain aspects of the present inventions.
Figure 9:
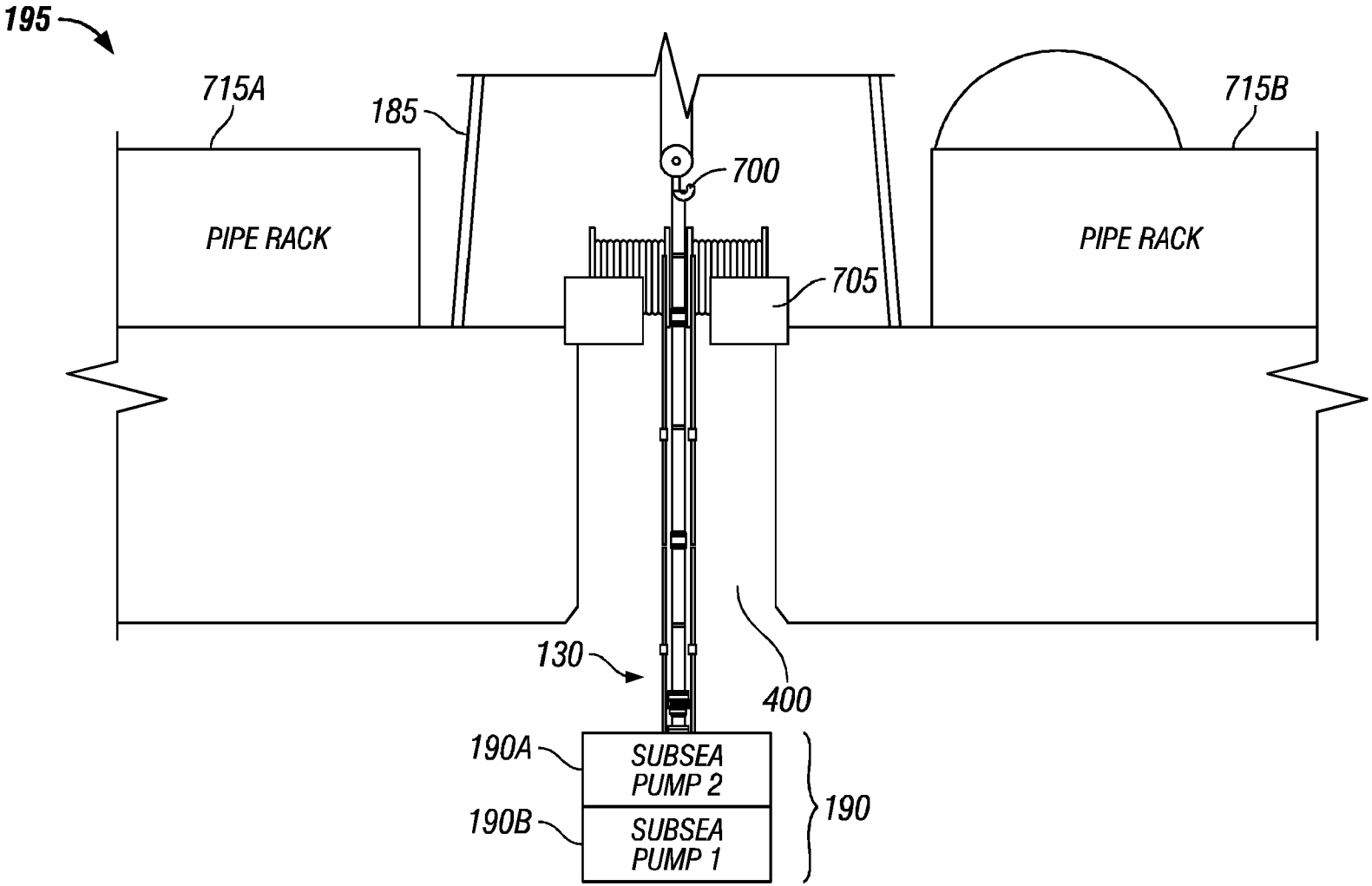
FIG. 9 illustrates a particular embodiment of the deployment of the deep sea mining riser and lift system utilizing certain aspects of the present inventions.

FIGS. 7-9 are illustrations of particular embodiments of the deployment of the deep sea mining riser and lift system utilizing certain aspects of the present inventions. FIG. 7 illustrates the riser hangoff structure 705, which may be a weldment, which fits in the ledge at the top of the moon pool and supports the riser during installation and mining operations. The riser hangoff structure (RHS) 705 with a gimbaled riser spider may be stacked on top of the subsea pump(s) 190. The combined assembly 720 may then be picked up by the rig hook 700 as a combined assembly. FIG. 8 illustrates the combined how assembly 720 may be lowered and hung off on the moon pool 140. A "ledge" at the top of the moon pool may be included to accommodate and support the riser hangoff structure 705. As is illustrated in FIG. 9, when the hook picks up the weight of subsea pump(s) 190 with the first riser joint of the riser 130, the riser hangoff structure 705 is disconnected from the subsea pump(s) 190 and the rest of the riser 130 picked up and installed.

Further, a derrick 185 may be centered over the moon pool. Riser pipe may be delivered to the derrick for installation from the catwalks. The catwalks on either side of the derrick may each have a riser catwalk candling tool, which may accept pipe delivered by the boom cranes and deliver it to the center of the derrick. There may be a pipe rack 715A and 715B (collectively 715) fore and aft of the derrick. One pipe rack may have skids supported above it. It is preferred that these skids be out of the way (deployed subsea or shifted) before this pipe is deployed. Subsea pumps and various skids will be delivered to the center of the derrick via a transporter skid which is opposite the draw work. Transporter skids can accept equipment from the deck crane and can either skid the equipment to the center line of the moon pool or be used to support hose reels as required for installation. The derrick can be complete with lights, communications, industrial air, and hydraulic supply as required. The hoisting equipment, which can be used to deploy the riser and pump system, consists of draw-works, crown block, traveling block with dolly and bales and elevators. Utility air tuggers may also situated on the main deck under the derrick to assist riser handling operations.

The process of "stacking" the riser hangoff structure 705 on top of the subsea pump(s) 190 allows for a simple rig design without the necessity of having complicated structures using hydraulically skidded or hinged support structures. It may also be desirable to hang off or support the subsea pump (s) 190 from below while activating a hydraulically skidded or hinged support structure.

Other and further embodiments utilizing one or more aspects of the inventions described above can be devised without departing from the spirit of Applicant's invention. Further, the various methods and embodiments of the deep sea mining riser and lift system can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A method of deep sea mining on a seafloor, comprising:

mining solids from the seafloor with a subsea miner;

pumping the solids from the subsea miner through a jumper;

pumping the solids from the jumper through a riser to a surface vessel;

monitoring the distance between the subsea miner and at least one subsea pump module; and adjusting the distance between the subsea miner and the at least one subsea pump module to within a tolerance to minimize a force on the subsea miner from the subsea pump module.

2. The method of claim 1, wherein an inner diameter of the jumper is smaller than an inner of diameter of the riser.

3. The method of claim 1, wherein the solids comprise seafloor massive sulfide deposits.

4. The method of claim 1, further comprising dewatering the solids.

5. The method of claim 1, further comprising discharging a quantity of wastewater used to pump the solids near to the seafloor.

6. The method of claim 1, wherein the pumping is performed by at least one subsea pumps.

7. The method of claim 1, wherein the jumper is "S" shaped.

8. The method of claim 1, further comprising pumping a quantity of wastewater into one or more water injection lines piggy backed onto the riser.

9. The method of claim 8, wherein pumping the solids from the jumper comprises pumping with a pump module having a compression chamber, and further comprising at least partially powering the compression chamber with the wastewater from the one or more water injection lines.

10. The method of claim 1, further comprising coupling a dump valve assembly to the pump module.

11. The method of claim 10, further comprising remotely opening the dump valve assembly.

12. The method of claim 11, wherein remotely opening the dump valve assembly comprises using a subsea remotely operated vehicle (ROV), a pump power pack, or a combination thereof.

13. A deep sea mining system on a seafloor, comprising:

a subsea miner coupled to a substantially horizontal jumper, a pump module coupled to the substantially horizontal jumper distally from the subsea miner;

a riser system coupled to the pump module; and a surface vessel coupled to the riser system distally from the pump module;

wherein a solid is mined from the seafloor and pumped to the surface vessel;

wherein the surface vessel comprises a computer which monitors a distance between the subsea miner and the pump module, the surface vessel being adapted to respond to the computer and adjust the distance between the subsea miner and the pump module to within a tolerance to minimize a force on the subsea miner from the subsea pump module.

14. The system of claim 13, wherein the solid comprises a seafloor massive sulfide deposit.

15. The system of claim 13, further comprising a surface pump to dewater the solid.

16. The system of claim 13, wherein a quantity of wastewater is discharged near to the seafloor.

17. The system of claim 13, wherein the pump module comprises a subsea module located near to the seafloor.

18. The system of claim 13, wherein an inner diameter of the jumper is smaller than an inner of diameter of the riser.

19. The system of claim 13, wherein a dump valve assembly is coupled to the pump module.

20. The system of claim 19, wherein the dump valve assembly is adapted to be remotely opened.

21. The system of claim 20, further comprising a subsea remotely operated vehicle (ROV), a pump power pack, or a combination thereof coupled to the dump valve assembly.

22. The system of claim 13, further comprising one or more water injection lines adapted to allow the quantity of wastewater to flow therethrough, wherein the one or more injection lines are piggy backed to the riser system.

23. The system of claim 22, wherein the wastewater at least partially powers a compression chamber of the pump module.

24. A method of deploying a deep sea mining system, comprising:

stacking a riser hangoff structure above a subsea pump module;

picking up the riser hang off structure and the subsea pump module by a hanging mechanism;

hanging the riser hangoff structure and the subsea pump module on a moon pool;

attaching a first riser joint;

separating the riser hangoff structure from the subsea pump module by an increased distance compared to a distance between the riser hangoff structure and the subsea pump module when hung on the moon pool; and attaching at least one second riser joint to form a riser.

* * * * *